US007596958B2

(12) United States Patent
Wagner et al.

(10) Patent No.: US 7,596,958 B2
(45) Date of Patent: Oct. 6, 2009

(54) REFRIGERATION SYSTEM WITH FIBER OPTIC SENSING

(75) Inventors: Dennis L. Wagner, Manchester, MO (US); Michael P. Kolve, Saint Charles, MO (US); Sesha C. Madireddi, Saint Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 540 days.

(21) Appl. No.: 11/384,570

(22) Filed: Mar. 20, 2006

(65) Prior Publication Data

US 2007/0214812 A1 Sep. 20, 2007

(51) Int. Cl.
*G01K 13/00* (2006.01)

(52) U.S. Cl. ..... 62/126; 62/127; 62/129; 62/131; 236/51; 700/276

(58) Field of Classification Search ..... 62/129
See application file for complete search history.

(56) References Cited

U.S. PATENT DOCUMENTS

| | | | | | |
|---|---|---|---|---|---|
| 3,718,814 | A | | 2/1973 | Van Slyke | |
| 4,015,182 | A | | 3/1977 | Erdman | |
| 4,049,644 | A | | 9/1977 | Wennerstrom | |
| 4,205,533 | A | | 6/1980 | Sterling | |
| 4,306,612 | A | * | 12/1981 | Baker et al. | 165/9 |
| 4,566,285 | A | * | 1/1986 | Tershak et al. | 62/129 |
| 4,605,925 | A | | 8/1986 | Mark | |
| 4,621,502 | A | * | 11/1986 | Ibrahim et al. | 62/223 |
| 4,706,169 | A | | 11/1987 | Bussan et al. | |
| 4,812,810 | A | * | 3/1989 | Query et al. | 340/545.3 |
| 4,843,833 | A | | 7/1989 | Polkinghorne | |
| 4,860,551 | A | * | 8/1989 | Query | 62/140 |
| 5,390,506 | A | * | 2/1995 | Sogabe et al. | 62/175 |
| 5,464,588 | A | | 11/1995 | Bather et al. | |
| 5,504,325 | A | | 4/1996 | Talmon et al. | |
| 5,684,296 | A | | 11/1997 | Hamblin et al. | |
| 5,701,235 | A | | 12/1997 | Hagemeyer Cook et al. | |
| 5,743,135 | A | | 4/1998 | Sayka et al. | |
| 6,131,471 | A | | 10/2000 | Okoren et al. | |
| 6,225,904 | B1 | | 5/2001 | Jaffe et al. | |
| 6,321,555 | B1 | | 11/2001 | Buratti et al. | |
| 6,411,215 | B1 | | 6/2002 | Shnier | |
| 6,631,622 | B1 | | 10/2003 | Ghent et al. | |
| 6,735,970 | B1 | | 5/2004 | Bocchini | |
| 6,771,177 | B2 | | 8/2004 | Alderman | |
| 2003/0167783 | A1 | * | 9/2003 | Goth et al. | 62/157 |
| 2005/0169636 | A1 | * | 8/2005 | Aronson et al. | 398/136 |

* cited by examiner

*Primary Examiner*—Cheryl J Tyler
*Assistant Examiner*—Jonathan Koagel
(74) *Attorney, Agent, or Firm*—Michael Best & Friedrich LLP

(57) ABSTRACT

A refrigeration case monitoring system. In one embodiment, the refrigeration case monitoring system includes a first fiber optic cable, a second fiber optic cable, and a control system having a first sensing channel and a second sensing channel. The first fiber optic cable transmits a signal that is indicative of a refrigeration case condition. The second fiber optic cable transmits a signal that is indicative of a second refrigeration case condition. The control system receives the signals from the first and second fiber optic cables using the first and second sensing channels, processes the signals, and provides an output related to the first and second refrigeration case conditions.

18 Claims, 6 Drawing Sheets

REFRIGERATION SYSTEM WITH FIBER OPTIC SENSING

BACKGROUND

The present invention relates to refrigeration systems. More specifically, the present invention relates to refrigeration system sensing apparatus and methods.

Refrigerated display cases are widely used in supermarket and other retail venues to keep perishable items cool. Some refrigeration cases are equipped with sensing or monitoring equipment that determines malfunctioning refrigeration case components. For example, refrigeration case monitoring equipment can be used to detect fan failure, a blocked drain, burned out or faulty lights, an open refrigeration case door, and a blocked evaporator coil. Due to the potentially large number of doors, fans, and lights that are included in some refrigeration cases, the cost of the sensing or monitoring equipment can be significant. Monitoring equipment may also need to be resistant to electromagnetic interference ("EMI") and/or radio frequency interference ("RFI") from other electrical components in the refrigeration case, such as lighting ballasts. Additionally, monitoring equipment may need to be able to withstand constantly cold temperatures and exposure to moisture.

SUMMARY

The following summary sets forth certain example embodiments of the invention described in greater detail below. It does not set forth all such embodiments and should in no way be construed as limiting of the invention.

In one embodiment, the invention provides a refrigeration case monitoring system that includes a first fiber optic cable, at least one second fiber optic cable, and a control system having a first sensing channel and at least one second sensing channel. The first fiber optic cable is configured to transmit a signal indicative of a refrigeration case condition. The at least one second fiber optic cable is configured to transmit a signal indicative of a second refrigeration case condition. The control system is configured to receive the signals from the first and at least one second fiber optic cable, process the signals, and generate an output related to the first and second refrigeration case conditions.

In another embodiment, a refrigeration case monitoring system includes at least one fiber optic cable, a first controller having at least one sensing channel, and a second controller. The at least one fiber optic cable is configured to transmit a signal indicative of a refrigeration case condition. The first controller is configured to receive the signal from the at least one fiber optic cable, process the signal, and transmit a signal related to the refrigeration case condition. The second controller is configured to be electrically connected to the first controller and to receive, from the first controller, the signal related to the refrigeration case condition and to generate an output related to the refrigeration case condition.

In another embodiment, the invention provides a method of monitoring a refrigeration case. The method includes monitoring, by at least one fiber optic sensor, a first and at least one second refrigeration case condition. The first and at least one second refrigeration case conditions can include an open door condition, a frosted coil condition, a fan failure condition, a blocked drain condition, or a lighting failure condition. A signal indicative of the refrigeration case condition is transmitted by the fiber optic sensor. A control system receives the signal from the sensor and processes the signal. Processing the signal can include conditioning the signal. The control system then generates an output indicative of the refrigeration case condition.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including,""comprising," or "having" and variations thereof herein is meant to encompass the items listed thereafter and equivalents thereof as well as additional items. Unless specified or limited otherwise, the terms "mounted, ""connected,""supported," and "coupled" and variations thereof are used broadly and encompass both direct and indirect mountings, connections, supports, and couplings. Further, "connected" and "coupled" are not restricted to physical or mechanical connections or couplings.

Embodiments of the invention relate to systems and methods of monitoring refrigeration case component conditions. In an embodiment, a refrigeration case monitoring system is provided that utilizes fiber optic cables to transmit component condition data to a controller. Such a system can be implemented cost effectively. For example, embodiments herein can reduce implementation costs by detecting multiple refrigeration case component conditions with similarly configured fiber optic cables. Additionally, fiber optic cables can be used to transmit signals that are resistant to EMI and RFI.

As used herein, the term "refrigeration case component" refers generally to a variety of refrigeration apparatuses and mechanisms used to carry out the functions of a refrigeration system. For example, a typical commercial refrigeration case may include refrigeration case components such as one or more doors, drains, lights, fans, evaporators, condensers, compressors, and the like. Other refrigeration systems (e.g., a vehicle refrigeration system) may be configured with similar or different refrigeration case components.

Figure 1:
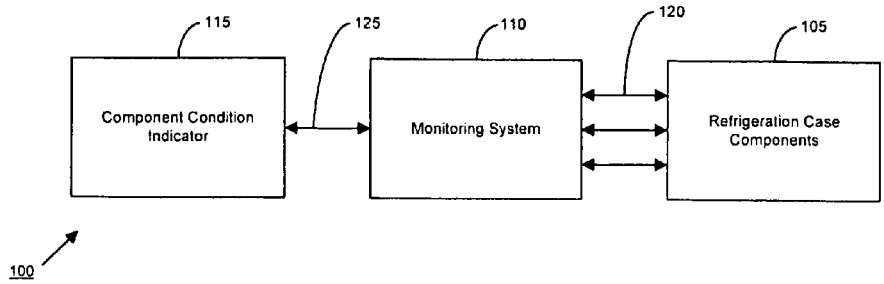
FIG. 1 is a block diagram of a refrigeration case system according to one embodiment of the invention.

FIG. 1 is a block diagram of a refrigeration system 100 according to one embodiment of the present invention. The refrigeration system 100 includes one or more refrigeration case components 105, a monitoring system 110, and a component condition indicator 115. The refrigeration case components 105 are monitored by the monitoring system 110 using one or more fiber optic cables 120, as described in greater detail below.

The refrigeration case components 105 that are monitored by the monitoring system 110 vary depending on the components 105 that are included in the refrigeration system 100. For example, some refrigeration systems 100 have relatively few components to monitor, while other larger refrigeration systems may include a plurality of doors, lights, drains, and the like. The desired complexity and expense of the monitoring system 110 can also determine which refrigeration case components 105 are monitored by the monitoring system 110. For example, in one embodiment, refrigeration case components 105 such as doors, drains, evaporator coils, lights, and fans are monitored using the monitoring system 110. In other embodiments, only a subset of refrigeration case components in the refrigeration system 100 are monitored (e.g., the doors and the lights only).

The monitoring system 110 can include one or more fiber optic cables 120 and corresponding sensors that comprise electronic hardware and/or software components. For example, in one embodiment, the monitoring system 110 includes a plurality of light sensors (e.g., a photosensitive transistor, photodiode, photo resistor, and the like), which provide signals that are interpreted by a controller, as described in greater detail below.

In some embodiments, the refrigeration case component condition indicator ("condition indicator") 115 produces one or more audible and/or visual signals to indicate a refrigeration case component condition. A refrigeration case component condition can be, for example, whether or not a refrigeration case component is operating correctly (i.e., a fault or failure condition). A refrigeration case component condition may also be a functional state of a particular component. For example, in one embodiment, the monitoring system 110 monitors the status of a door of the refrigeration system 100 using one or more fiber optic cables 120 of a door monitoring sensor (as described in greater detail with respect to FIGS. 3A-3B). The monitoring system 110 transmits a variable signal 125 to the condition indicator 115 depending on the state of the door (i.e., the door is open or the door is closed). The condition indicator 115 indicates the door's condition (e.g., the door is open) using an audible and/or visual signal.

Figure 2:
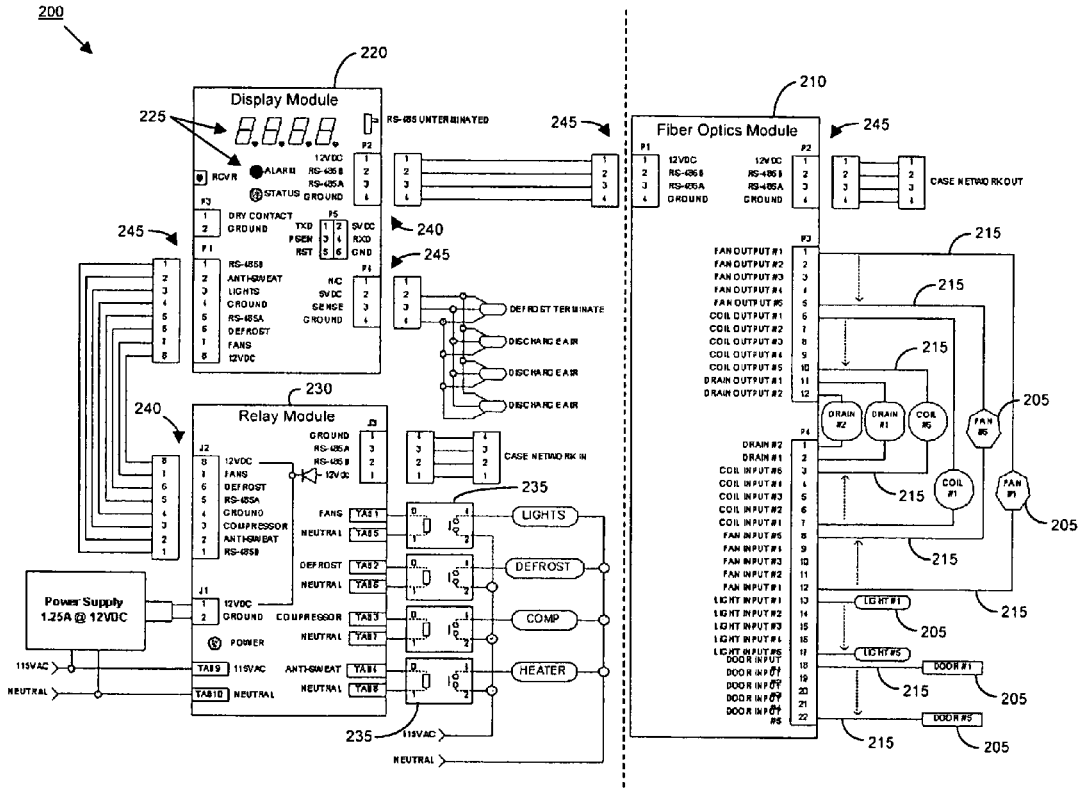
FIG. 2 is a block diagram of a refrigeration case control system according to one embodiment of the invention.

FIG. 2 is a schematic diagram of a refrigeration case control system 200 according to an embodiment of the present invention. In the embodiment shown in FIG. 2, the refrigeration case control system 200 includes a plurality of refrigeration case component sensors (shown generally by blocks 205) having a plurality of fiber optic cables 215 that communicate with a fiber optics module 210. The refrigeration case control system 200 also includes a display module 220 having a condition indicator 225, and a relay module 230 having a plurality of associated relay circuits 235.

The refrigeration case component sensors 205 monitor refrigeration case component conditions by detecting light signals using one or more fiber optic cables 215. As described in greater detail below, several of the sensors 205 detect light signals that are transmitted by one fiber optic cable 215 and received by another fiber optic cable 215. In another embodiment, the sensors 205 detect ambient light signals in an area near the end of the fiber optic cables 215. In yet another embodiment, the sensors 205 detect light signals that are transmitted onto a reflective surface by one fiber optic cable 215 and reflected back to, and received by another fiber optic cable 215. The sensors 205 can also include one or more lenses (not shown) that are positioned proximate to ends of the fiber optic cables 215. The lenses sharpen or focus the light signals prior to the light signals reaching the fiber optic cables 215. Additionally or alternatively, the sensors 205 can include other signal conditioners (not shown) to modify and/or amplify the light signals prior to the light signals reaching the fiber optic cables 215.

The fiber optic cables 215 convey light signals that are passed from the sensors 205 to the fiber optics module 210 and vice versa. In an embodiment, the fiber optic cables 215 are extruded plastic fibers having an outer surface coating. In other embodiments, the fiber optic cables can be made of different materials (e.g., glass) and can have a variety of outer surface coatings (e.g., plastic cladding, ultraviolet curable coatings, etc.). The fiber optic cables 215 are generally flexible, which allows them to bend to a certain degree and to be positioned in various locations in and around components of the refrigeration system.

In some embodiments, the fiber optics module 210 generates light signals that are transmitted by the fiber optic cables 215 of the sensors 205. In other embodiments, the fiber optics module 210 processes light signals that are received by the fiber optic cables 215 of the sensors 205. Processing the light signals that are received by the fiber optic cables 215 of the sensors 205 can include converting an analog light signal to a digital signal and conditioning the signal (e.g., amplifying the signal, comparing the signal to a threshold, etc.). Additionally, in some embodiments, the fiber optics module 210 includes a fault detection module that verifies whether the light signals received from the fiber optic cables 215 of the sensors 205 are valid.

The display module 220 includes a condition indicator 225 that displays one or more conditions of the refrigeration case components. The condition indicator 225 includes, for example, one or more lights, light emitting diodes ("LEDs") (e.g., a seven segment LED), or liquid crystal displays ("LCDs") that visually display a condition of a refrigeration case component. The condition indicator 225 may also include a buzzer, horn, or other audible alarm, which provides an audible refrigeration case component condition. In some embodiments, the display module 220 also includes one or more input ports 240 and output ports 245, which allow the display module 220 to communicate with other modules (e.g., the fiber optics module 210, the relay module 230, etc.). As such, the display module 220 can process signals received from the other modules with a processor or other controller, and display a corresponding condition on the condition indicator 225. For example, in one embodiment, the fiber optics module 210 transmits a signal to the display module 220 that is indicative of a blocked drain condition. The display module 220 receives the signal via an input port 240, processes or interprets the signal, and displays an appropriate message or code on the condition indicator 225 (depicted in FIG. 2 as an LED display). Additionally, in some embodiments, upon receiving the signal from the fiber optics module 210 indicating that a blocked drain condition is present, the display module 220 transmits a signal to the relay module 230 via an output port 245 to shut down one or more components of the refrigeration case (described below).

The relay module 230 can include a plurality of the relay circuits 235 that switch multiple components of the refrigeration case on and off in response to conditions sensed by other modules. For example, in one exemplary embodiment, the fiber optics module 210 transmits a signal to the display module 220 that is indicative of a frosted coil condition. The display module 220 processes the signal from the fiber optics module 210, displays a corresponding fault code on the condition indicator 225, and transmits a signal to the relay module 230. The relay module 230 receives the signal from the display module 220 and actuates a compressor relay circuit 235 to shut off a compressor of the refrigeration case. The relay module 230 can include a controller to determine which relay circuits 235 to actuate. For example, in an embodiment, the relay module 230 receives a signal from another module (described above), and processes the received signal with the controller. After the signal is processed by the controller, the relay module 230 transmits a signal to a relay circuit 235 to turn a refrigeration case component on or off. In another embodiment, the relay module 230 does not include intelligent electronics (e.g., a controller), and utilizes control signals that are passed to the relay module 230 from another module to actuate the relay circuits 235.

In an alternative embodiment, the refrigeration control system 200 can be configured differently, for example, having each of the modules described above integrated into a single control module. In such an embodiment, the integrated control system communicates with the sensors 205, processes the sensor signals, displays a component condition, and actuates a relay circuit in response to the condition without having to transmit signals from one module to another.

Figure 3:
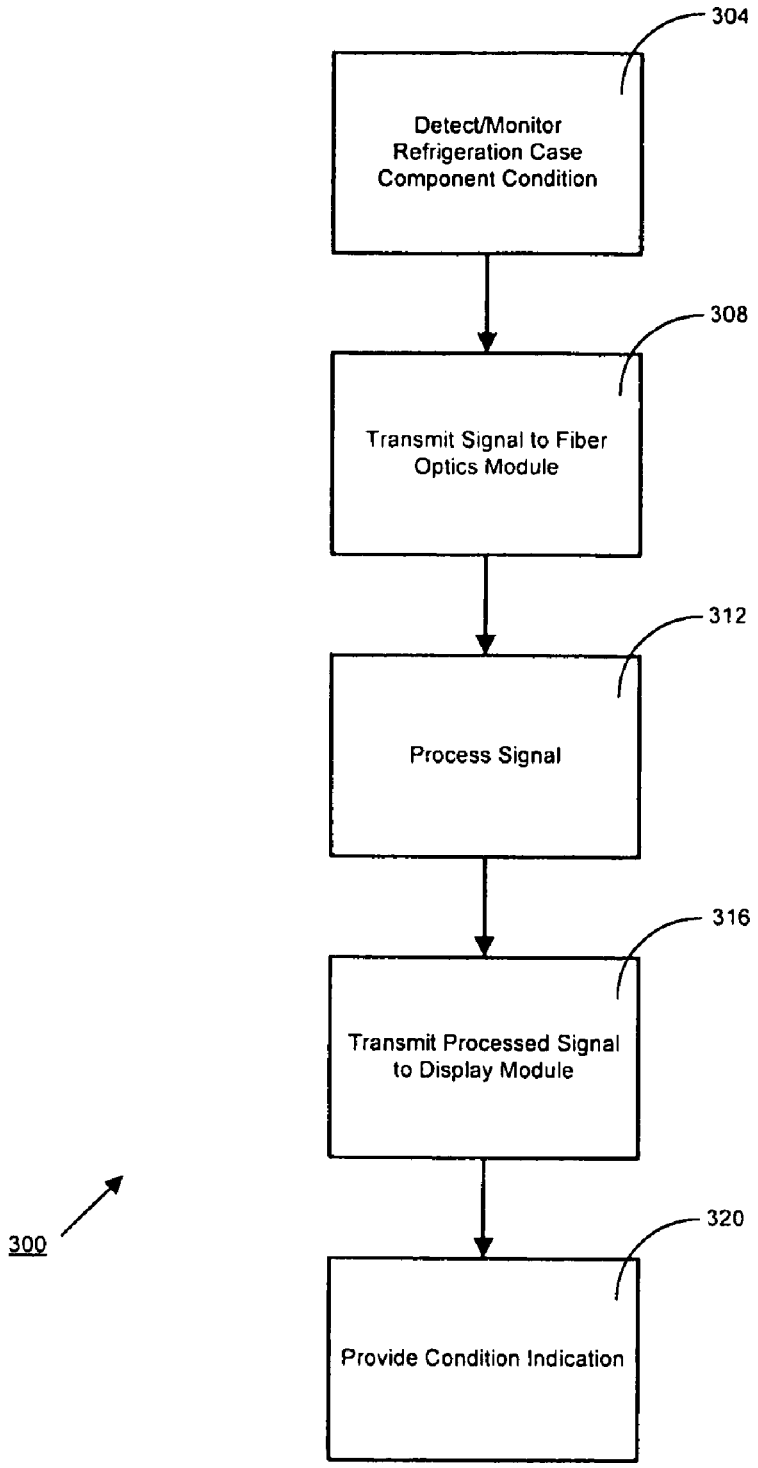
FIG. 3 illustrates an exemplary process by which a refrigeration case component condition is detected and indicated.

FIG. 3 illustrates a process 300 by which a refrigeration component condition is detected and indicated. The process 300 can be completed, for example, using the refrigeration control system 200. The process 300 begins by detecting a refrigeration case component condition with a refrigeration case component sensor 205 (step 304). The refrigeration case component sensor 205 transmits a signal indicative of the component condition to the fiber optics module 210 using the fiber optic cable 215 (step 308). After the fiber optics module 210 receives the signal from the sensor 205, the fiber optics module 210 processes the sensor signal (step 312). Processing the sensor signal includes, for example, conditioning the signal (e.g., amplifying the signal, converting the signal from an analog signal to a digital signal, etc.). Processing the signal can also include comparing the signal to a predefined threshold value (described below). After the signal has been processed (step 312), the processed signal can be sent to the display module (step 316), which can use the processed signal to provide a condition indication (step 320) with the condition indicator 225.

Figure 4A:
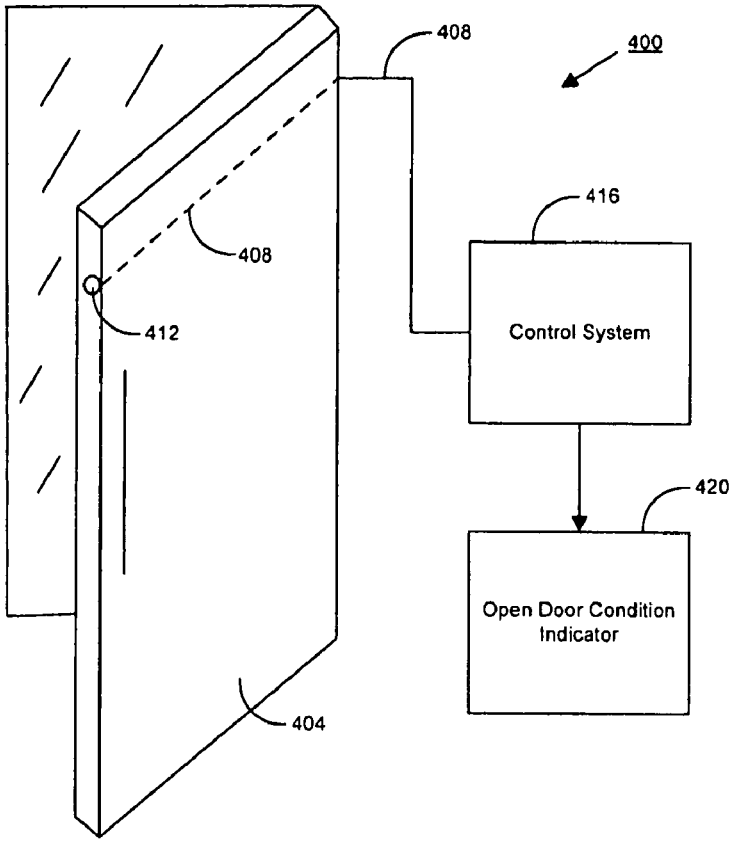
FIG. 4A illustrates a refrigeration case monitoring system according to one embodiment of the invention.

FIG. 4A illustrates an open door monitoring system 400 that includes a refrigeration case door 404, a fiber optic cable 408 having a cable end 412, a control system 416, and an open door condition indicator 420. In other embodiments, the open door monitoring system 400 can be configured differently. For example, in an alternative embodiment, two or more fiber optic cables can be included in the system 400. The open door monitoring system 400 detects an open door condition by measuring the ambient light near the end 412 of the fiber optic cable 408. When the refrigeration case door 404 is closed, very little light is exposed to the end 412 of the fiber optic cable 408. However, when the refrigeration case door 404 is opened, the end 412 of the fiber optic cable 408 is exposed to measurable light. As a result, light travels down the length of the fiber optic cable 408 and is received by the control system 416. The control system 416 then compares the light signal to a predetermined threshold value to determine if an open door condition exists. In some embodiments, a measurement is made of the intensity of ambient light that normally surrounds an open refrigeration case door in a typical refrigeration case door location (e.g., a supermarket). The threshold value can then be set to a value that is less than the normal ambient light intensity, so that when the refrigeration case door 404 is opened, the light that is present at the end 412 of the fiber optic cable 408 exceeds the threshold value. The threshold value can be adjusted according to the location of the refrigeration case door 404. If the control system 416 determines that the light signal is sufficient enough to indicate an open door condition, the open door condition indicator 420 is actuated. The open door condition indicator 420 produces an audible and/or visual signal (described above) that indicates that the refrigeration case door 404 is in the open position.

In some embodiments, two or more fiber optic cables are used to detect a refrigeration case component condition. In such embodiments, a fault checking (e.g. a fiber optic fault checking system) can be implemented to verify that the signals received by the fiber optic cables are valid. For example, in an embodiment, an additional fiber optic cable 408 can be added to the bottom portion of the refrigeration case door 404 (shown in FIG. 4A), and both fiber optic cables 408 can be used to detect light signals when the refrigeration case door 404 is in the open position. If one of the fiber optic cables detects an open door condition (e.g., light is surrounding the end 412 of the cable), and the other fiber optic cable does not detect an open door condition (e.g., there is an absence of measurable light surrounding the end 412 of the cable), a faulty fiber optic cable may be identified. In other embodiments, more than two fiber optic cables can be implemented to detect an open door condition.

Figure 4B:
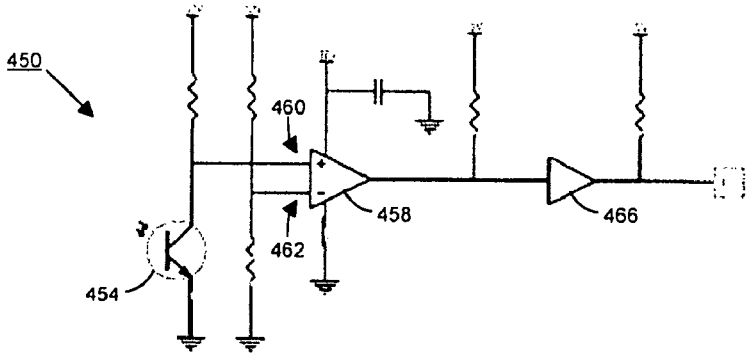
FIG. 4B is a schematic diagram of an exemplary circuit that detects an open refrigeration case door condition.

FIG. 4B is a schematic diagram of an exemplary open door circuit 450 that is implemented to detect an open refrigeration case door condition. In some embodiments, open door circuit 450 is included in the control system 416 described with respect to FIG. 4A. The open door circuit 450 generally includes a photosensitive transistor 454, an operational amplifier ("op amp") 458 having an input terminal 460 and a reference terminal 462, and a buffer circuit 466. In an embodiment, the photosensitive transistor 454 receives light from the fiber optic cable 408 (e.g., if the door 404 is open as shown in FIG. 4A) and transmits a voltage signal to the input terminal 460 of the op amp 458. The op amp 458 compares the voltage signal at the input terminal 460 to a reference or threshold signal at the reference terminal 462. If the voltage signal at the input terminal 460 is above a predetermined threshold (i.e., the voltage signal at the reference terminal 462), the comparator circuit becomes active and transmits a voltage signal to the buffer circuit 466. If the signal at the input terminal 460 does not meet or exceed the signal at the reference terminal 462, no signal is transmitted to the buffer circuit 466. The buffer circuit 466 amplifies the voltage signal from the op amp 458 and transmits the signal to a controller (e.g., a microprocessor). In some embodiments, the controller (not shown) evaluates the signal received from the buffer circuit 466, and determines a condition of the refrigeration case door 404 (e.g., open or closed). For example, if the controller receives a signal from the buffer 466, the controller determines that the door 404 is open. If the controller does not receive a signal from the buffer 466, the controller determines that the door 404 is closed. In other embodiments, the open door circuit can be configured differently. For example, in other embodiments, the photosensitive transistor 454 can be replaced by another photosensitive component (e.g., a photocell, a photo diode, and the like). Additionally, in some embodiments, functions performed by certain hardware components shown in FIG. 4B (e.g., the op amp) can be performed by software in the controller.

Figure 5A:
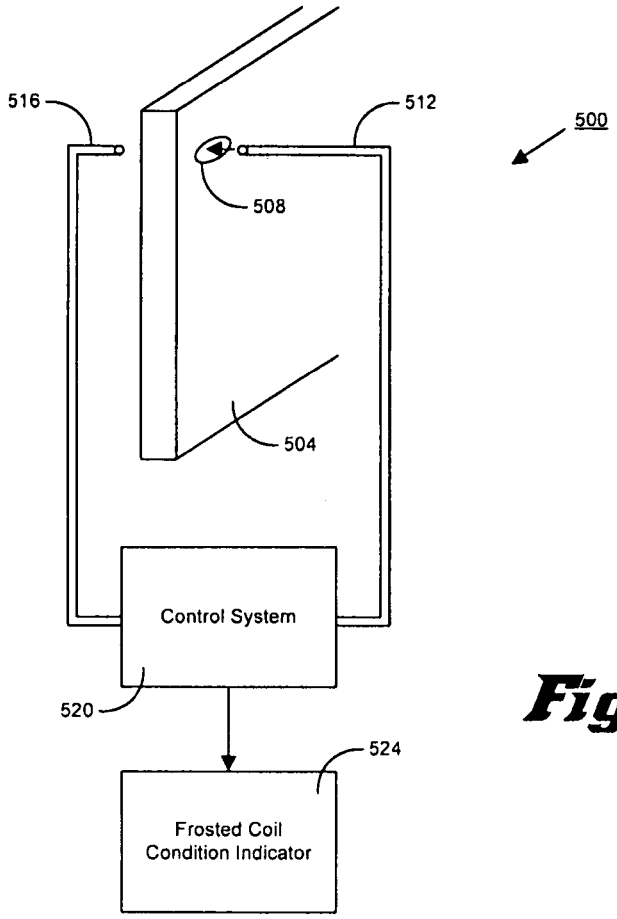
FIG. 5A illustrates a refrigeration case monitoring system that detects a frosted refrigeration coil condition according to one embodiment of the invention.

FIG. 5A illustrates a frosted coil monitoring system 500 that includes a fin 504 of an evaporator coil (not shown) having a hole 508, a first fiber optic cable 512, a second fiber optic cable 516, a control system 520, and a frosted coil condition indicator 524. The frosted coil monitoring system 500 detects a frosted or bunkered evaporator coil of a refrigeration unit by measuring the integrity of a light beam that is transmitted by the control system 520 from the first fiber optic cable 512 to the second fiber optic cable 516. When little or no frost has formed on the evaporator fin 504, the light beam that is transmitted by the control system 520 from the first fiber optic cable 512 to the second fiber optic cable 516 is relatively unimpeded while passing through the hole 508 in the fin 504. As such, the light beam that is received by the second fiber optic cable 516 has relatively the same strength and direction as when it was transmitted from the first fiber optic cable 512. However, if a significant amount of frost has formed on the fin 504 (indicating that there is likely frost on the entire coil), the light that passes through the hole 508 from the first fiber optic cable 512 to the second fiber optic cable 516 will be altered (e.g., the intensity of the light is reduced, the direction of the light is altered, etc.). The control system 520 monitors the light signal that is received by the second fiber optic cable 516, and compares that signal to the light signal that was transmitted from the first fiber optic cable 512. If there is a significant difference in the signals, the control system 520 can actuate the frosted coil condition indicator 524, which can be an audible and/or visual signal, as previously described.

Figure 5B:
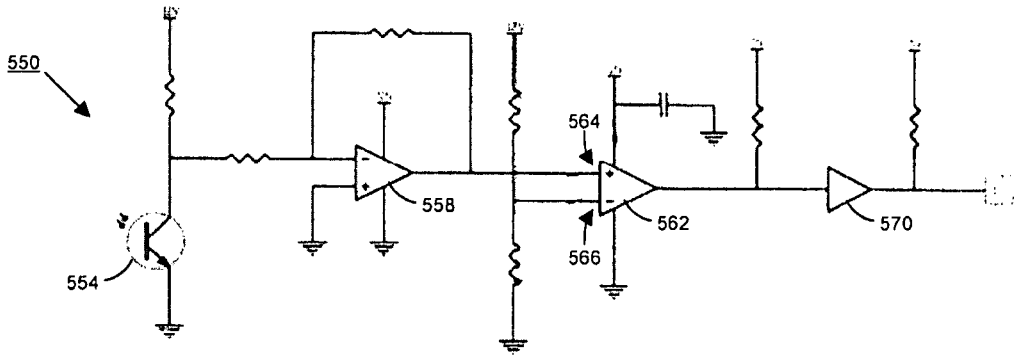
FIG. 5B is a schematic diagram of an exemplary circuit that detects a frosted coil condition according to one embodiment of the invention.

FIG. 5B is a schematic diagram of an exemplary frosted coil circuit 550 that detects a frosted coil condition. In some embodiments, the frosted coil circuit 550 is included in the control system 520 described with respect to FIG. 5A. The frosted coil circuit generally includes a photosensitive transistor 554, a first op amp 558, a second op amp 562 having an input terminal 564 and a reference terminal 566, and a buffer circuit 570. In an embodiment, the photosensitive transistor 554 receives light from the second fiber optic cable 516 (FIG. 5A) and transmits a voltage signal to the first op amp 558. Light is received, for example, if there is little or no frost (or other material) impeding the light that is transmitted by the first fiber optic cable 512, as previously described. The first op amp 558 amplifies the signal received from the photosensitive transistor 554, and transmits the amplified signal to the input terminal 564 of the second op amp 562. Similar to the embodiment shown in FIG. 4B, the second op amp 562 compares the voltage signal at the input terminal 564 to a reference or threshold signal at the reference terminal 566. If the voltage signal at the input terminal 564 is above a predetermined threshold, the comparator circuit turns on and transmits a voltage signal to the buffer circuit 570. The buffer circuit 570 conditions the voltage signal from the second op amp 562 and transmits the signal to a controller. The controller (not shown) then evaluates the signal received from the buffer circuit 570, and determines if frost has formed on the fin 504 (FIG. 5A). For example, if the controller receives a signal from the buffer 570, the controller determines that the fin 504 is relatively free of frost. If, however, the controller does not receive a signal from the buffer 570, the controller determines that frost has formed on the evaporator coil, and may initiate a defrosting function. Similar to the embodiment described with respect to FIG. 4B, the embodiment shown in FIG. 5B may also be implemented in alternative manners. For example, the photosensitive transistor 554 can be replaced by another photosensitive component (e.g., a photocell, a photo diode, and the like). Additionally, the functions performed by certain hardware components shown in FIG. 5B (e.g., the first op amp, the second op amp, etc.) can be performed by software in the controller.

Figure 6A:
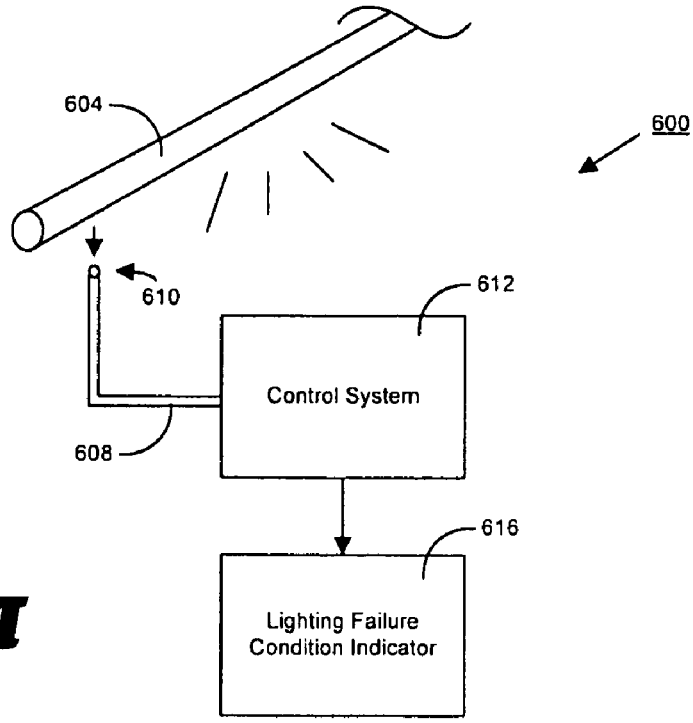
FIG. 6A illustrates a refrigeration case monitoring system that detects a lighting failure condition according to one embodiment of the invention.

FIG. 6A illustrates a lighting failure monitoring system 600 that includes a refrigeration case light 604, a fiber optic cable 608 having a cable end 610, a control system 612, and a lighting failure condition indicator 616. The lighting failure monitoring system 600 detects a refrigeration case light failure by measuring the intensity of light in an area near the refrigeration case light 604 (e.g., a florescent light). Under normal operating conditions, the refrigeration case light 604 is lit. As such, a relatively high intensity light surrounds the end 610 of the fiber optic cable 608 and is transmitted down the length of the fiber optic cable 608 to the control system 612. The control system 612 receives the light signal from the fiber optic cable 612, and compares the signal to a predetermined light threshold value. If the light signal received from the fiber optic cable 612 falls below the predetermined light threshold value, the control system 612 can indicate that the refrigeration case light 604 has burnt out (or is in the process of burning out) using the lighting failure condition indicator 616. In some embodiments, additional fiber optic cables (not shown) can be used with the same light to detect a lighting failure. As such, a fiber optic fault checking system (similar to that described with respect to FIG. 4A) can be implemented to verify that the signals received by the multiple fiber optic cables are valid.

Figure 6B:
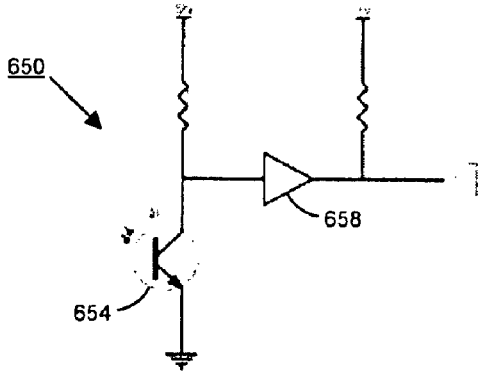
FIG. 6B is a schematic diagram of an exemplary circuit that detects a lighting failure condition according to one embodiment of the invention.

FIG. 6B is a schematic diagram of an exemplary lighting failure circuit 650 that detects a lighting failure condition. In some embodiments, the lighting failure circuit 650 is included in the control system 612 described with respect to FIG. 6A. The lighting failure circuit generally includes a photosensitive transistor 654 and a buffer circuit 658. In an embodiment, the photosensitive transistor 654 receives light from the fiber optic cable 608 (FIG. 6A) and transmits a voltage signal to the buffer circuit 658. Light is received by the fiber optic cable 608, for example, when the light 604 that is being monitored is emitting a light signal (e.g., the light is turned on). Alternatively, if the light 604 in the refrigeration case is not lit (e.g., the light is off), relatively little measurable light is received by the fiber optic cable 608. The buffer circuit 658 conditions the signal received from the photosensitive transistor 654, and transmits the conditioned signal to a controller (not shown), which evaluates the signal received from the buffer circuit 658, and determines if the light 604 is being lit. For example, if the controller receives a signal from the buffer 658, the controller determines that the light 604 is lit. If, however, the controller does not receive a signal from the buffer 658, the controller determines that the light has failed. In other embodiments, the lighting failure circuit 650 can be configured differently, as previously described.

Figure 7:
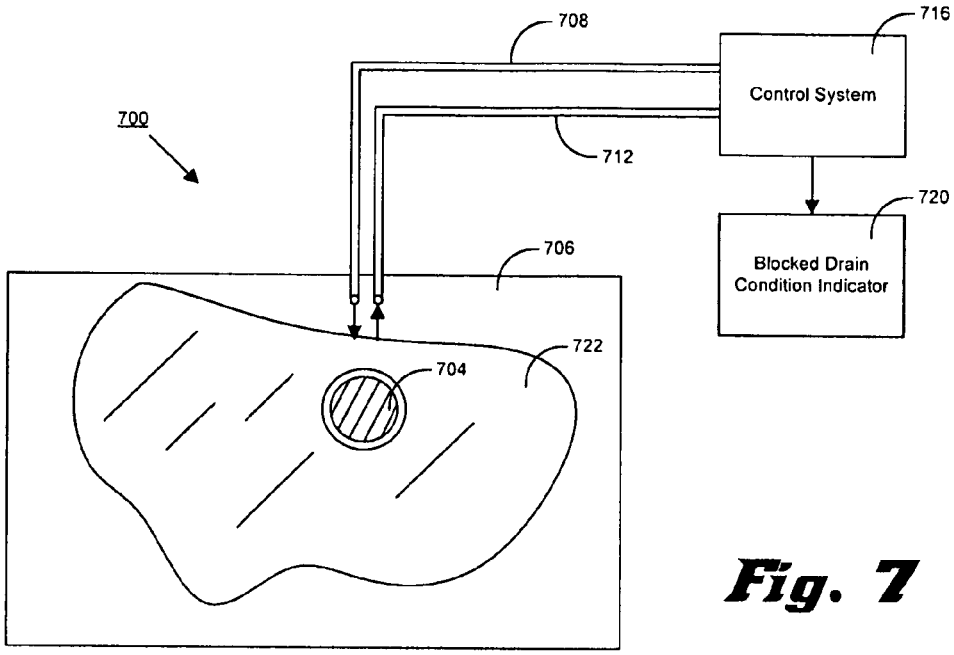
FIG. 7 illustrates a refrigeration case monitoring system that detects a blocked drain condition according to one embodiment of the invention.

FIG. 7 illustrates a blocked drain monitoring system 700 that includes a drain 704 surrounded by a surface 706, a first fiber optic cable 708, a second fiber optic cable 712, a control system 716, and a blocked drain condition indicator 720. The blocked drain monitoring system 700 detects a blocked drain condition by measuring light signals near the surface 706. For example, in an embodiment, the control system 716 transmits a light beam onto the surface 706 using the first fiber optic cable 708. If no water or other liquid is present on the surface 706, the light that is transmitted by the first fiber optic cable 708 is not substantially reflected toward the second fiber optic cable 712. If, however, water or another liquid 722 has collected near the drain 704 (indicating that the drain is blocked), the light transmitted by the first fiber optic cable 708 reflects back toward the second fiber optic cable 712. The second fiber optic cable 712 receives the reflected light, and transmits that light to the control system 716. Upon receiving the reflected light, the control system 716 indicates that a blocked drain condition exists using the blocked drain condition indicator 720.

Figure 8A:
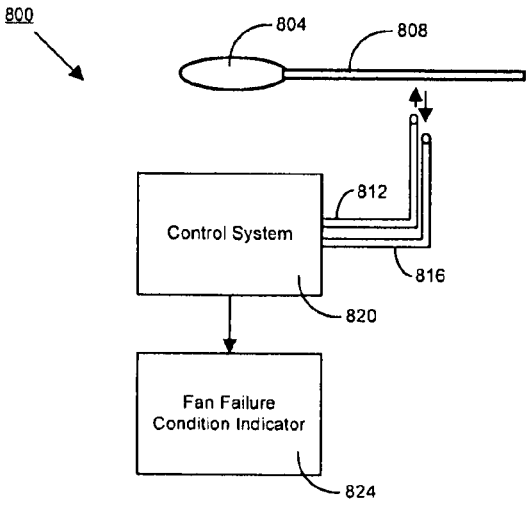
FIG. 8A illustrates a refrigeration case monitoring system that detects a fan failure condition according to one embodiment of the invention.
Figure 8B:
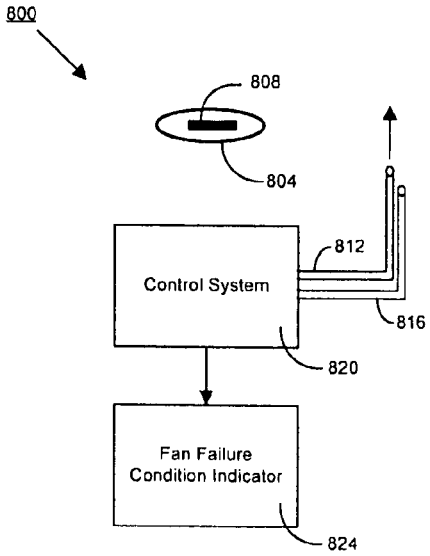
FIG. 8B illustrates another embodiment of the refrigeration case monitoring system shown in FIG. 8A.

FIGS. 8A and 8B illustrate a fan failure monitoring system 800 that includes a fan 804 having at least one fan blade 808, a first fiber optic cable 812, a second fiber optic cable 816, a control system 820, and a fan failure condition indicator 824. The fan failure monitoring system 800 detects a failed fan 804 by measuring the light that is reflected from the fan blade(s) 808. More specifically, in some embodiments, the control system 820 transmits a continuous light beam using the first fiber optic cable 812. When the fan blade 808 passes by the end of the first fiber optic cable 812 (FIG. 8A), the light that is transmitted by the first fiber optic cable 812 is reflected back to the second fiber optic cable 816. The second fiber optic cable 816 receives the reflected light and transmits the light signal to the control system 820. When a fan blade is not present (FIG. 8B), however, no reflected light is received by the second fiber optic cable 816, and no light is transmitted to the control system 820. As such, the control system 820 receives intermittent light signal pulses as the fan blades 808 pass the ends of the first and second fiber optic cables 812 and 816. If the intermittent light pulses stop for a predetermined amount of time, the control system 820 determines that the fan has failed, and is no longer turning the blades 808. The control system 820 then indicates the fan failure condition with the fan failure condition indicator 824.

Although some of the embodiments described herein relate to free standing supermarket refrigeration cases with doors that open and close, it should be understood that the monitoring techniques described above can be used in a variety of refrigeration applications. For example, in other embodiments, the monitoring system can be used to monitor a vehicle refrigeration mechanism (e.g., a refrigerated truck). In another embodiment, the monitoring system can be used to monitor a different style of refrigeration case (e.g., an open air refrigeration case without doors). Additionally or alternatively, in other embodiments, a monitoring system can be interfaced with a security system. For example, the opening of a refrigeration case door in a chemical laboratory may indicate a security breach.

Various embodiments of the invention are set forth in the following claims.

The invention claimed is:

1. A refrigeration case monitoring system comprising:

a first fiber optic cable positioned at a first end of a refrigeration case door and configured to transmit a first signal indicative of a first refrigeration case condition;

at least one second fiber optic cable configured to transmit a second signal indicative of a second refrigeration case condition that is different than the first refrigeration case condition;

a control system having a first sensing channel and at least one second sensing channel, wherein the control system is configured to receive and process the signals from the first and at least one second fiber optic cables, wherein the first signal is compared to a first threshold value, and the second signal is compared to a second threshold value, and wherein the control system generates a first output related to the first refrigeration case condition if the first signal exceeds the first threshold value, and generates a second output related to the second refrigeration case condition if the second signal exceeds the second threshold value; and a fiber optic fault checking system having a third fiber optic cable positioned at a second end of the refrigeration case door and configured to transmit a third signal indicative of the first refrigeration case condition, the fiber optic fault checking system comparing the first and third signals to identify a faulty fiber optic cable, wherein the fiber optic cable is identified as faulty when the first and third signals are different.

2. The monitoring system of claim 1, wherein the first and second outputs are at least one of an audible signal and a visual signal.

3. The monitoring system of claim 1, wherein the control system is configured to interface with a controller.

4. The monitoring system of claim 1, wherein the control system comprises an analog-to-digital signal converter configured to process the signals received from the first and at least one second fiber optic cables.

5. The monitoring system of claim 1, wherein the control system comprises at least one amplifying circuit configured to amplify the signals received from the first and at least one second fiber optic cables.

6. The monitoring system of claim 1, wherein the first signal indicative of the first refrigeration case condition at least partially depends on a light signal that is received by the first fiber optic cable.

7. The monitoring system of claim 6, wherein the light signal is received by the first fiber optic cable from a fourth fiber optic cable.

8. The monitoring system of claim 1, wherein the second refrigeration case condition is one of a frosted coil condition and a fan failure condition.

9. The monitoring system of claim 1, wherein the second refrigeration case condition is one of a blocked drain condition and a lighting failure condition.

10. A refrigeration case monitoring system comprising:

at least one first fiber optic cable configured to transmit a first signal indicative of a first refrigeration case condition;

at least one second fiber optic cable configured to transmit a second signal indicative of a second refrigeration case condition that is different than the first refrigeration case condition;

a first controller having at least one sensing channel, wherein the first controller is configured to receive and process the first signal from the at least one first fiber optic cable, and the second signal from the at least one second fiber optic cable, wherein the first signal is compared to a first threshold value, and the second signal is compared to a second threshold value, and wherein the first controller transmits a signal related to the first refrigeration case condition if the first signal exceeds the first threshold value, and a signal related to the second refrigeration case condition if the second signal exceeds the second threshold value;

a second controller configured to be electrically connected to the first controller and to receive, from the first controller, the first signal and the second signal, and to generate a first output related to the first refrigeration case condition and a second output related to the second refrigeration case condition; and a fiber optic fault checking system having a third fiber optic cable and configured to transmit a third signal indicative of the first refrigeration case condition, the fiber optic fault checking system comparing the first and third signals to identify a faulty fiber optic cable, wherein the fiber optic cable is identified as faulty when the first and third signals are different.

11. The refrigeration case monitoring system of claim 10, wherein the second controller is configured to control operations of the refrigeration case.

12. The refrigeration case monitoring system of claim 10, wherein the second controller is an integrated component of the refrigeration case monitoring system.

13. The refrigeration case monitoring system of claim 10, wherein the first controller includes a network port configured to be connected to an external electronic component.

14. A method of monitoring a refrigeration case, the method comprising:

monitoring, by a first fiber optic sensor, a first refrigeration case condition, and, by a second fiber optic sensor, at least one second refrigeration case condition that is different than the first refrigeration case condition, wherein the first refrigeration case condition is an open door condition, and the at least one second refrigeration case condition is of the group comprising, a fan failure condition, a blocked drain condition, and a lighting failure condition;

transmitting, by the first fiber optic sensor, a first signal indicative of the first refrigeration case condition, and by the second fiber optic sensor, a second signal indicative of the second refrigeration case condition;

receiving, by a control system having at least one sensing channel, the first signal from the first fiber optic sensor and the second signal from the second fiber optic sensor;

processing, by the control system, the first signal from the first fiber optic sensor and the second signal from the second fiber optic sensor, wherein processing the first signal from the first fiber optic sensor includes conditioning the first signal;

comparing the first signal to a first threshold value, and the second signal to a second threshold value;

generating, by the control system, a first output indicative of the first refrigeration case condition if the first signal exceeds the first threshold value;

generating, by the control system, a second output indicative of the second refrigeration case condition if the second signal exceeds the second threshold value; and transmitting, by a fiber optic fault checking system, a third signal indicative of the first refrigeration case condition, the fiber optic fault checking system comparing the first and third signals to identify a faulty fiber optic cable, wherein the fiber optic cable is identified as faulty when the first and third signals are different.

15. The method of claim 14, wherein conditioning the first signal includes amplifying the first signal.

16. The method of claim 14, wherein conditioning the first signal includes converting the first signal from an analog signal to a digital signal.

17. The method of claim 14, wherein processing the first signal includes determining if the first signal is less than a predetermined threshold.

18. The method of claim 14 further comprising monitoring for a frosted coil condition.

* * * * *

UNITED STATES PATENT AND TRADEMARK OFFICE

CERTIFICATE OF CORRECTION

PATENT NO. : 7,596,958 B2
APPLICATION NO. : 11/384570
DATED : October 6, 2009
INVENTOR(S) : Wagner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 740 days.

Signed and Sealed this

Twenty-eighth Day of September, 2010

David J. Kappos

David J. Kappos
*Director of the United States Patent and Trademark Office*